US011905943B2

(12) United States Patent
Xu et al.

(10) Patent No.: US 11,905,943 B2
(45) Date of Patent: Feb. 20, 2024

(54) MULTI-STAGE ELECTRIC GAS PUMP

(71) Applicant: Fluke Corporation, Everett, WA (US)

(72) Inventors: Fudong Xu, Shanghai (CN); Hui Wang, Shanghai (CN); Shounan Luo, Shanghai (CN)

(73) Assignee: Fluke Corporation, Everett, WA (US)

( * ) Notice: Subject to any disclaimer, the term of this patent is extended or adjusted under 35 U.S.C. 154(b) by 0 days.

(21) Appl. No.: 17/538,751

(22) Filed: Nov. 30, 2021

(65) Prior Publication Data

US 2022/0170456 A1 Jun. 2, 2022

(30) Foreign Application Priority Data

Nov. 30, 2020 (CN) ..... 202011376346.3

(51) Int. Cl.

| | |
|---|---|
| ***F04B 49/12*** | (2006.01) |
| ***F04B 1/24*** | (2006.01) |
| ***F04B 17/03*** | (2006.01) |
| ***F04B 1/124*** | (2020.01) |

(52) U.S. Cl.

CPC ..... *F04B 49/125* (2013.01); *F04B 1/124* (2013.01); *F04B 17/03* (2013.01)

(58) Field of Classification Search

CPC ..... F04B 1/124; F04B 17/03; F04B 49/125

See application file for complete search history.

(56) References Cited

U.S. PATENT DOCUMENTS

| | | | | |
|---|---|---|---|---|
| 3,765,180 | A * | 10/1973 | Brown | F01B 17/02 60/415 |
| 8,418,493 | B2 * | 4/2013 | Chang | F04B 39/0094 74/567 |
| 8,887,621 | B2 * | 11/2014 | Ohata | F04B 39/0016 92/240 |
| 9,624,918 | B2 * | 4/2017 | Goertzen | F04B 25/00 |
| 2003/0108435 | A1 * | 6/2003 | Meyer | F04B 27/02 417/255 |
| 2009/0311114 | A1 * | 12/2009 | Schulz | F04B 25/02 417/254 |
| 2011/0011079 | A1 * | 1/2011 | Kamen | F25B 9/14 60/660 |
| 2016/0053707 | A1 * | 2/2016 | Batta | F02F 11/005 123/193.2 |
| 2019/0247969 | A1 * | 8/2019 | Rubens | F16D 3/04 |

* cited by examiner

*Primary Examiner* — Connor J Tremarche

(74) *Attorney, Agent, or Firm* — Seed IP Law Group LLP

(57) ABSTRACT

A multi-stage electric gas pump includes a driving mechanism and an eccentric shaft including a main body having a longitudinal axis, a first eccentric portion, and a second eccentric portion, wherein the first eccentric portion and the second eccentric portion are fixed on the main body. The eccentric shaft is driven by the driving mechanism to produce a first circular movement of the first eccentric portion around the longitudinal axis and a second circular movement of the second eccentric portion around the longitudinal axis, wherein the second circular movement is synchronized with the first circular movement. The multi-stage electric gas pump further includes a first cylinder, a second cylinder, and a third cylinder. The cylinders in three stages are driven by the eccentric shaft so as to achieve three-stage pressurization of gas.

18 Claims, 8 Drawing Sheets

MULTI-STAGE ELECTRIC GAS PUMP

BACKGROUND

Technical Field

The present disclosure relates to the technical field of gas pumps, and more specifically, to a multi-stage electric gas pump.

Description of the Related Art

A manual gas pump and an electric gas pump are two forms of pumps for providing a high-pressure gas source. During use of the manual gas pump, an operator needs to continuously operate the manual gas pump. In order to provide a sufficiently powerful gas pressure source, the operator needs to contribute heavy labor, and this greatly affects operation efficiency. Compared with the manual gas pump, the electric gas pump does not require heavy labor from the operator. However, a conventional electric gas pump is generally large in size and heavy, and the conventional electric gas pump is generally difficult to transport to an operation site. In addition, in a field that generally desires small and medium gas flows and high pressure, the conventional electric gas pump consumes a relatively large amount of energy, and has poor start-up performance.

Therefore, it is desired to provide an automated, small-sized, and highly integrated electric gas pump so as to satisfy preferences of a specific field.

BRIEF SUMMARY

In various aspects, the present disclosure provides a multi-stage electric gas pump that is generally small in size, high in integration degree, fast in startup, and low in energy consumption relative to conventional electrical gas pumps as discussed above. Such a multi-stage electric gas pump may be integrated in, for example, a portable high pressure calibration device so as to provide a designated high-pressure gas source.

In at least one aspect, the present disclosure provides a multi-stage electric gas pump, comprising a driving mechanism and an eccentric shaft comprising a main body having a longitudinal axis, a first eccentric portion, and a second eccentric portion. The first eccentric portion and the second eccentric portion are fixed on the main body. The eccentric shaft is driven by the driving mechanism to produce a first circular movement of the first eccentric portion performed around the longitudinal axis and a second circular movement of the second eccentric portion performed around the longitudinal axis, wherein the second circular movement is synchronized with the first circular movement. A first cylinder is comprised of a first chamber and a first piston rod. The first piston rod is connected to the first eccentric portion and is configured to reciprocate in response to the first circular movement of the first eccentric portion of the eccentric shaft so as to periodically pressurize gas drawn into the first chamber from an external environment of the multi-stage electric gas pump and then discharge first pressurized gas out of the first chamber. A second cylinder is in fluid communication with the first cylinder. The second cylinder is comprised of a second chamber and a second piston rod. The second piston rod is connected to the first eccentric portion of the eccentric shaft and is configured to reciprocate in response to the first circular movement of the first eccentric portion so as to periodically pressurize the first pressurized gas drawn into the second chamber from the first chamber of the first cylinder and then discharge second pressurized gas out of the second chamber. A third cylinder is in fluid communication with the second cylinder. The third cylinder is comprised of a third chamber and a third piston rod. The third piston rod is connected to the second eccentric portion of the eccentric shaft and is configured to reciprocate in response to the second circular movement of the second eccentric portion so as to periodically pressurize the second pressurized gas drawn into the third chamber from the second chamber of the second cylinder and then discharge third pressurized gas out of the third chamber.

In another aspect, the present disclosure provides a multi-stage electric gas pump, comprising a driving mechanism and an eccentric shaft comprising a main body having a longitudinal axis and at least one eccentric portion connected to the main body. The eccentric shaft is driven by the driving mechanism so that the at least one eccentric portion performs circular movement around the longitudinal axis; a first cylinder comprising a first chamber and a first piston rod, and the first piston rod being connected to the eccentric portion and being configured to reciprocate in response to the circular movement of the eccentric portion so as to periodically pressurize gas drawn into the first chamber from an external environment of the multi-stage electric gas pump and then discharge first pressurized gas out of the first chamber; a second cylinder being in fluid communication with the first cylinder, the second cylinder comprising a second chamber and a second piston rod, and the second piston rod being connected to the eccentric portion and being configured to reciprocate in response to the circular movement of the eccentric portion so as to periodically pressurize the first pressurized gas drawn into the second chamber from the first chamber of the first cylinder and then discharge second pressurized gas out of the second chamber; and a third cylinder being in fluid communication with the second cylinder, the third cylinder comprising a third chamber and a third piston rod, and the third piston rod being connected to the eccentric portion and being configured to reciprocate in response to the circular movement of the eccentric portion so as to periodically pressurize the second pressurized gas drawn into the third chamber from the second chamber of the second cylinder and then discharge third pressurized gas out of the third chamber, wherein the connections between the first piston rod, the second piston rod, the third piston rod and the eccentric portion are configured so that the second cylinder discharges gas while the first cylinder and the third cylinder draw in gas and that the second cylinder draws in gas while the first cylinder and the third cylinder discharge gas.

In another aspect, the present disclosure provides a high pressure calibration device comprising an embodiment of the multi-stage electric gas pump described herein so as to provide a high-pressure gas source.

The foregoing is a summary of the present disclosure where simplification, generalization, and omitted details may exist. Therefore, it should be appreciated by those skilled in the art that this summary section is for exemplary illustration only, and is not intended to limit the scope of the present disclosure.

BRIEF DESCRIPTION OF THE SEVERAL VIEWS OF THE DRAWINGS

The aforementioned features and other features of the present disclosure will be more fully and clearly understood through the specification below and the appended claims with reference to the accompanying drawings. It can be understood that these accompanying drawings illustrate only a few embodiments of the present disclosure, and therefore should not be considered as limiting the scope of the present disclosure. The content of the present disclosure will be described more explicitly and in more detail with the accompanying drawings.

Figure 1:
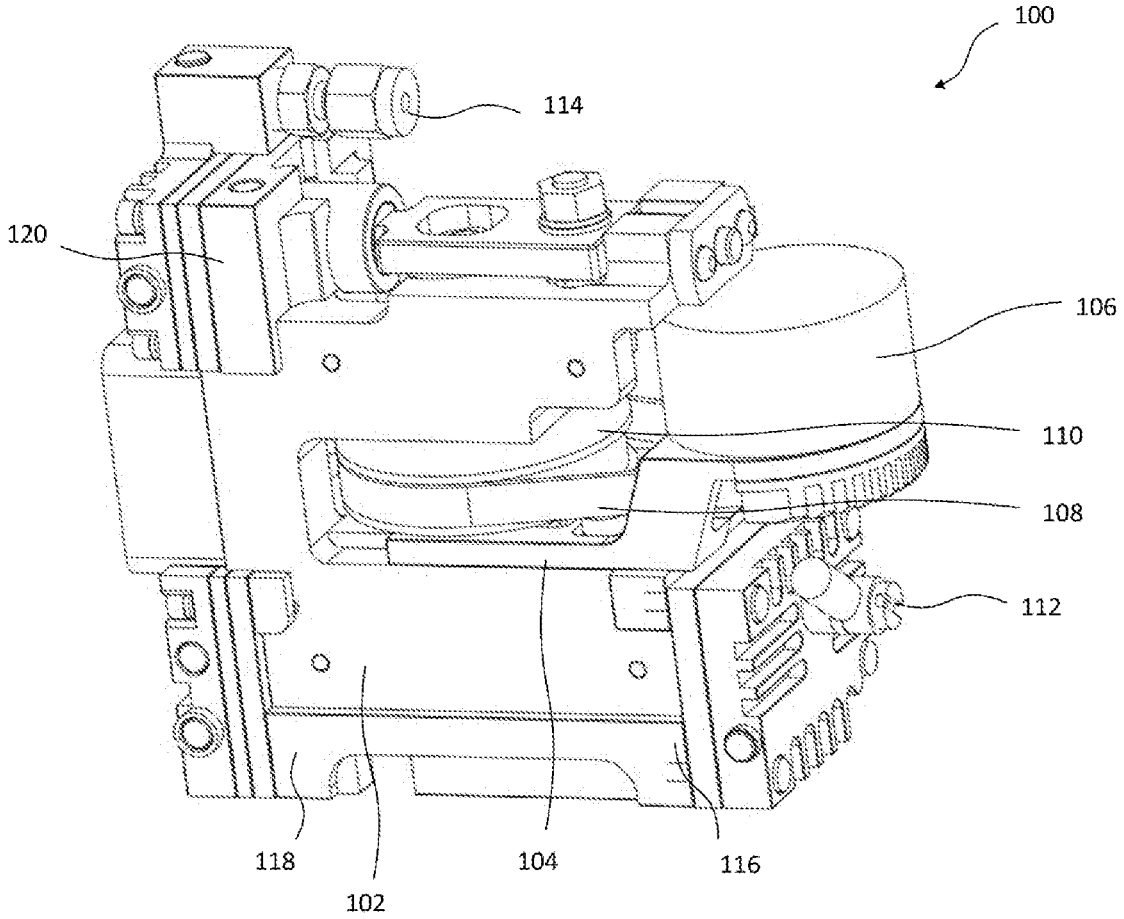
FIG. 1 shows a perspective view of a multi-stage electric gas pump according to an embodiment of the present disclosure.

Before any embodiment of the present disclosure is explained in detail, it should be understood that applications of the present disclosure are not limited to the details of construction and the arrangement of components set forth in the following description or shown in the following accompanying drawings. The present disclosure may have other embodiments, and may be practiced or implemented in various ways. In addition, it should be understood that the phraseology and terminology used herein are for the purpose of description and should not be regarded as limiting.

DETAILED DESCRIPTION

The following detailed description is made with reference to the accompanying drawings constituting a part of the description. Unless otherwise specified in the context, similar reference numerals usually represent similar components in the accompanying drawings. The illustrative embodiments described in the detailed description, the accompanying drawings, and the claims are not limiting. Without departing from the spirit or scope of the subject matter of the present disclosure, other embodiments can be adopted and other modifications can be made. It can be understood that the various aspects of the present disclosure generally described herein and graphically presented in the accompanying drawings may be arranged, replaced, combined, and designed in many different configurations, and these configurations all explicitly constitute a part of the present disclosure.

FIG. 1 shows a perspective view of a multi-stage electric gas pump 100 according to an embodiment of the present disclosure. As shown in FIG. 1, the gas pump 100 includes a frame 102 and a mounting plate 104 mounted on the frame 102. A motor 106 is mounted on the mounting plate 104 to provide a driving force when the motor 106 is under operation. When the motor 106 is operating, a driving wheel 107 (shown in FIG. 2) connected to the motor 106 drives an endless belt 108, and the endless belt 108 drives a driven wheel 110 to rotate. The endless belt 108 may be referred to as a belt, a motor belt, or the like, that readily drives the driven wheel 110. Other details of the driving mechanism will be described in detail below in conjunction with other accompanying drawings. In an embodiment, the motor 106 may be a brushless direct-current motor or another common motor or driving mechanism.

Continuing to refer to FIG. 1, the gas pump 100 includes a gas inlet 112 and a gas outlet 114. When the motor 106 is operating, gas in an environment outside the gas pump 100 can enter the gas pump 100 through the gas inlet 112, be pressurized by the gas pump 100, and then be discharged out of the gas pump 100 through the gas outlet 114. More specifically, the gas pump 100 includes a first cylinder 116, a second cylinder 118, and a third cylinder 120. The first cylinder 116 is operably in communication with the environment through the gas inlet 112, and is in fluid communication with the second cylinder 118 located downstream thereof. The second cylinder 118 is further in fluid communication with the third cylinder 120 located downstream thereof. The third cylinder 120 is operably in communication with the environment through the gas outlet 114, which is downstream from the third cylinder 120.

Figure 2:
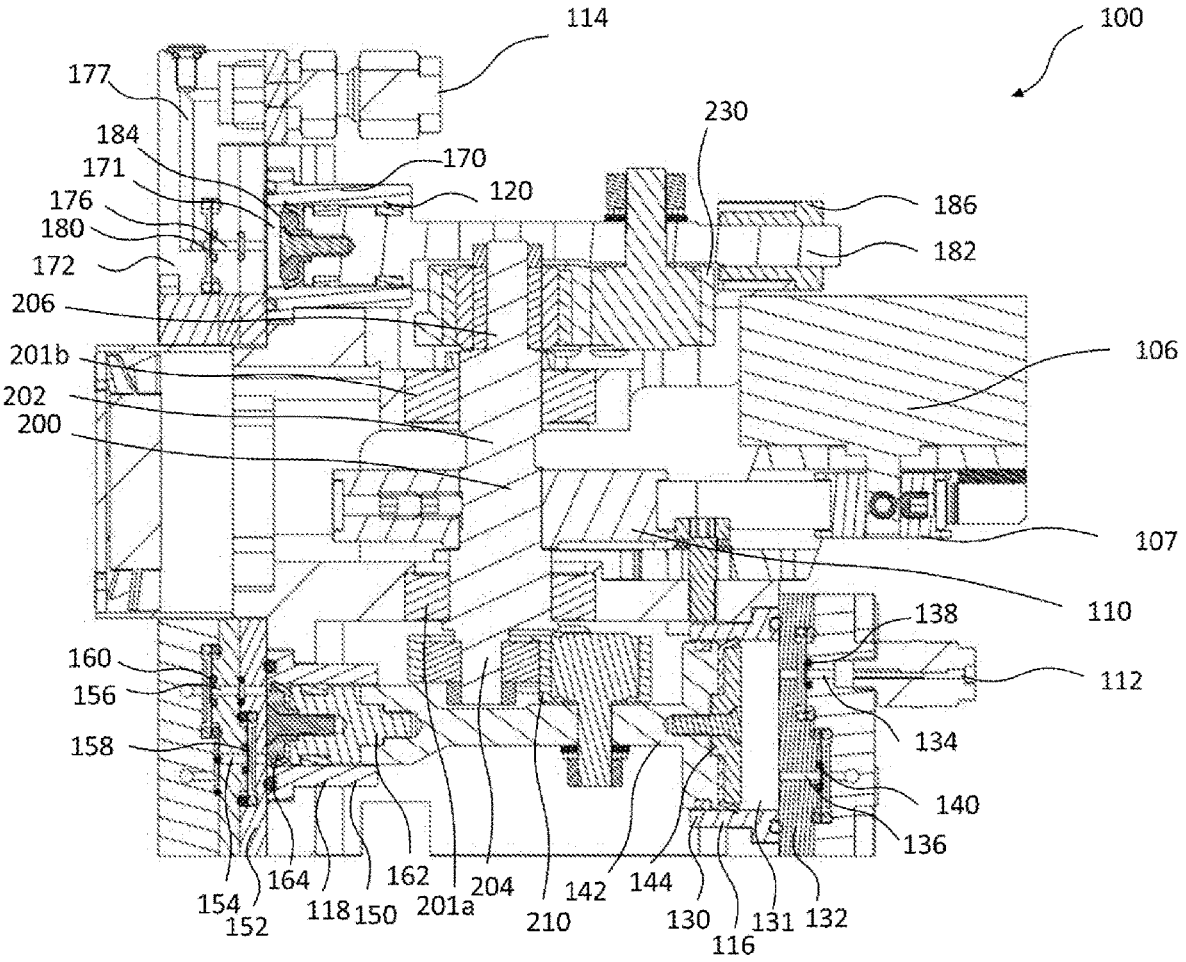
FIG. 2 shows a cross-sectional view of a multi-stage electric gas pump as shown in FIG. 1, and further shows an internal structure of the gas pump.

FIG. 2 shows a cross-sectional view of the multi-stage electric gas pump 100 as shown in FIG. 1, and further shows an internal structure of the gas pump 100. As shown in FIG. 2, the first cylinder 116 includes a first piston bush 130 defining a first chamber 131 and a first cylinder cover 132 sealedly connected to the first piston bush 130. The first cylinder cover 132 and the first piston bush 130 may at least partially delimit the first chamber 131. The first cylinder cover 132 includes a first inlet 134 and a first outlet 136. The first inlet 134 is in fluid communication with the gas inlet 112, and the first outlet 136 is in fluid communication with the second cylinder 118. In an embodiment, the first inlet 134 is provided with a check valve 138, and the check valve 138 allows gas to enter the first chamber 131 only from the environment outside the gas pump 100. In addition, the first outlet 136 is provided with a check valve 140, and the check valve 140 allows gas to be discharged downstream only from the first chamber 131. In an embodiment, the first cylinder 116 further includes a first piston rod 142. The first piston rod 142 includes a first piston cup 144 matching the first piston bush 130. The first piston cup 144 may be made of a rubber material, and, therefore, may be referred to herein as a first piston rubber cup. The first piston rubber cup 144 is configured to seal the first piston bush 130 together with the first cylinder cover 132. The first piston rod 142 can drive the first piston rubber cup 144 to reciprocate in the first chamber 131 to periodically change the volume of the first chamber 131 so as to continuously draw in gas from the environment through the first inlet 134 (during at least part of a time period when the first piston rod 142 moves in a left direction as shown in FIG. 2, the check valve 138 at the first inlet 134 is opened, and the check valve 140 at the first outlet 136 is closed) and discharge the pressurized gas through the first outlet 136 (during at least part of a time period when the first piston rod 142 moves in a right direction as shown in FIG. 2, the check valve 138 at the first inlet 134 is closed, and the check valve 140 at the first outlet 136 is opened). In other words, the first piston rod 142 may move in a leftward direction and a rightward direction, respectively, based on the orientation shown in FIG. 2, resulting in the first piston rubber cup 144 moving toward and away from the first cylinder cover 132, respectively.

Continuing to refer to FIG. 2, similar to the first cylinder 116, the second cylinder 118 includes a second piston bush 150 defining a second chamber 151 (shown in FIG. 4) and a second cylinder cover 152 sealedly connected to the second piston bush 150. The second cylinder cover 152 includes a second inlet 154 and a second outlet 156. The second piston bush 150 and the second cylinder cover 152 at least partially delimit the second chamber 151. The second inlet 154 is in fluid communication with the first outlet 136, and the second outlet 156 is in fluid communication with the third cylinder 120. For example, a fluid pipeline may be provided between the second inlet 154 and the first outlet 136, and/or a fluid pipeline may be provided between the second outlet 156 and the third cylinder 120. In an embodiment, the second inlet 154 is provided with a check valve 158, and the check valve 158 allows pressurized gas provided through the second inlet 142 to move upstream to enter the second chamber 151 only. In addition, the second outlet 156 is provided with a check valve 160, and the check valve 160 allows gas to be discharged only through the second outlet 156 downstream from the second chamber 151. In an embodiment, the second cylinder 118 further includes a second piston rod 162. The second piston rod 162 includes a second piston cup 164 matching the second piston bush 150. The second piston cup 164 may be made of a rubber material, and therefore, may be referred to herein to as a second piston rubber cup. The second piston rubber cup 164 is configured to seal the second piston bush 150 together with the second cylinder cover 151. The second piston rod 162 can drive the second piston rubber cup 164 to reciprocate in the second chamber 151 so as to continuously draw the pressurized gas from the first chamber 131 through the second inlet 154 and discharge the pressurized gas through the second outlet 156. In an embodiment, the second piston rod 162 and the first piston rod 142 are fixedly connected to each other, and the orientations of the second piston rod 162 and the first piston rod 142 (in FIG. 2, the first piston rod 142 is directed towards the right, and the second piston rod 162 is directed towards the left) are opposite, so that when the first piston rod 142 draws gas into the first chamber 131 through the first inlet 134, the second piston rod 162 discharges gas out of the second chamber 151 through the second outlet 156 (in a state as shown in FIG. 2). When the first piston rod 142 discharges pressurized gas out of the first chamber 131 through the first outlet 136, the second piston rod 162 draws, through the second inlet 154, the pressurized gas discharged out of the first chamber 131 into the second chamber 151. In this manner, the gas can be pressurized stage by stage by means of the first cylinder 116 and the second cylinder 118. In other words, the second piston rod 162 may move in a leftward direction and a rightward direction, respectively, based on the orientation shown in FIG. 2, resulting in the second piston rubber cup 164 moving toward and away from the second cylinder cover 152, respectively.

Figure 3:
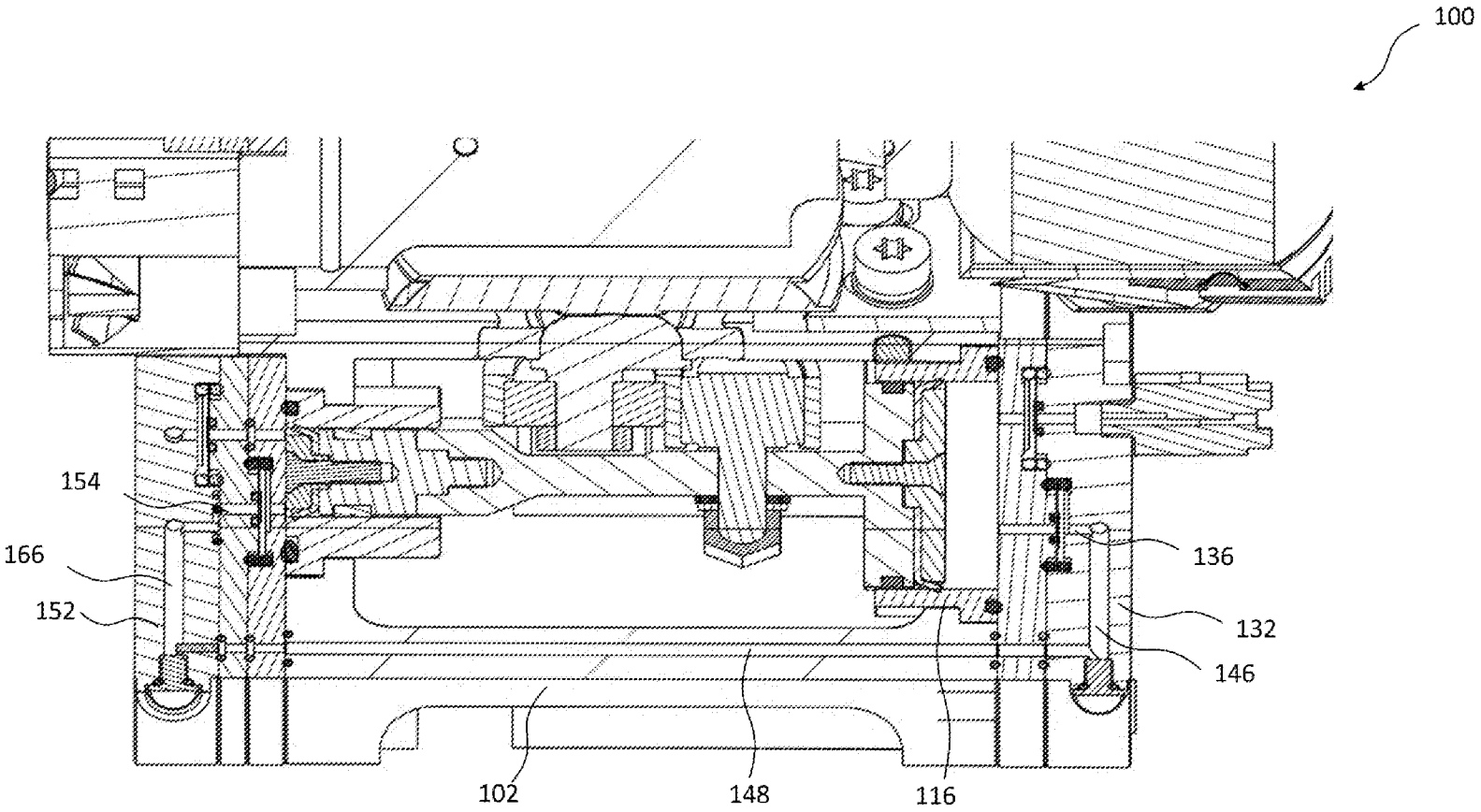
FIG. 3 shows a cut view of a multi-stage electric gas pump at an angle, and shows a fluid passage between a first cylinder and a second cylinder.

FIG. 3 shows a cut view of the multi-stage electric gas pump 100 rotated by an angle, and shows a fluid passage between the first cylinder 116 and the second cylinder 118. As shown in FIG. 3, after being discharged out of the first chamber 131 through the first outlet 136, the pressurized gas enters, through a passage 146 located in the first cylinder cover 132, a passage 148 located in the frame 102, and further enters the second chamber 151 through a passage 166 located in the second cylinder cover 152 and the second inlet 154.

As shown in FIG. 2, the third cylinder 120 includes a third piston bush 170 defining a third chamber 171 and a third cylinder cover 172 sealedly connected to the third piston bush 170. The third cylinder cover 172 and the third piston bush 170 may at least partially delimit the third chamber 171. The third cylinder cover 172 includes a third inlet 174 (shown in FIG. 5) and a third outlet 176, and the third outlet 176 is in fluid communication with the gas outlet 114 through a passage 177 located in the third cylinder cover 172. In an embodiment, the third outlet 176 is provided with a check valve 180, and the check valve 180 allows gas to be discharged only from the third chamber 171. In an embodiment, the third cylinder 120 further includes a third piston rod 182. The third piston rod 182 includes a third piston cup 184 matching the third piston bush 170. The third piston cup 184 may be made of a rubber material, and therefore, may be referred to herein as a third piston rubber cup. The third piston rubber cup 184 is configured to seal the third piston bush 170 together with the third cylinder cover 172. The third piston rod 182 can drive the third piston rubber cup 184 to reciprocate in the third chamber 171 so as to continuously draw in gas from the second chamber 151 through the third inlet 174 and discharge pressurized gas through the third outlet 176. In other words, the third piston rod 182 may move in a leftward direction and a rightward direction, respectively, based on the orientation shown in FIG. 2 resulting in the third piston rubber cup 184 moving toward and away from the third cylinder cover 172, respectively.

In some embodiments, the third cylinder 120, the second cylinder 118, and the first cylinder 116 are configured to have substantially the same structure, and gradually pressurize inflowing gas in a similar manner until a desired pressure is reached. It can be understood that in some other embodiments, these cylinders may also be configured to have different structures or have different maximum volumes, or cylinders in more stages may be provided for stage-by-stage pressurization. In some embodiments, respective maximum volumes of the first chamber 131, the second chamber 151, and the third chamber 171 of the first cylinder 116, the second cylinder 118, and the third cylinder 120 respectively, are decreasing, so that after entering the second chamber 151, the gas discharged out of the first chamber 131 is further compressed due to a difference between the maximum volumes of the first chamber 131 and the second chamber 151, and that after entering the third chamber 171, the gas discharged out of the second chamber 151 is further compressed due to a difference between the maximum volumes of the second chamber 151 and the third chamber 171. In some embodiments, the maximum volume of the first chamber 131 may be approximately four times the maximum volume of the second chamber 151, and the maximum volume of the second chamber 151 may be approximately twice the maximum volume of the third chamber 171. Those skilled in the art can configure other maximum volume ratios, and this is not limited in the present disclosure.

In an embodiment, the third piston rod 182 is parallel to the first piston rod 142 and the second piston rod 162, and an orientation of the third piston rod 182 is the same as the orientation of the second piston rod 162. However, the directions of driving forces received by the second piston rod 162 and the third piston rod 182 may be opposite, so that opening and closing timings of the second cylinder 118 and the third cylinder 120 match each other. Therefore, the second cylinder 118 may discharge gas while the third cylinder 120 draws in gas so as to cause the pressurized gas to flow unidirectionally between the two respective cylinders. It can be understood that in some other embodiments, respective positions of these cylinders and orientations of the piston rods may be adjusted according to preferences as long as stage-by-stage flowing of the gas in these cylinders is not affected.

In an embodiment, when the third piston rod 182 draws gas into the third chamber 171 through the third inlet 174, the second piston rod 162 discharges gas out of the second chamber 151 through the second outlet 156 (in a state as shown in FIG. 2), and when the third piston rod 182 discharges pressurized gas out of the third chamber 171 through the third outlet 176, the second piston rod 162 draws, through the second inlet 154, the pressurized gas discharged out of the first chamber 131 into the second chamber 151. It can be learned that the first cylinder 116, the second cylinder 118, and the third cylinder 120 pressurize the gas from the environment stage by stage by way of cooperation between gas drawing and gas discharging of the first piston rod 142, the second piston rod 162, and the third piston rod 182. Specifically, when the first cylinder 116 draws in gas, the second cylinder 118 discharges gas, and the third cylinder 120 draws in gas, and when the first cylinder 116 discharges gas, the second cylinder 118 draws in gas, and the third cylinder 120 discharges gas.

In the embodiment of FIG. 2, the multi-stage electric gas pump 100 uses a single eccentric shaft 200 to transmit to a plurality of piston rods a driving force provided by the motor. The plurality of piston rods may include the first, second, and third piston rods 142, 162, 182, respectively. The following will further describe the cooperation between gas drawing and gas discharging of the first piston rod 142, the second piston rod 162, and the third piston rod 182 in conjunction with features of the multi-stage electric gas pump 100 related to the eccentric shaft 200.

Figure 4:
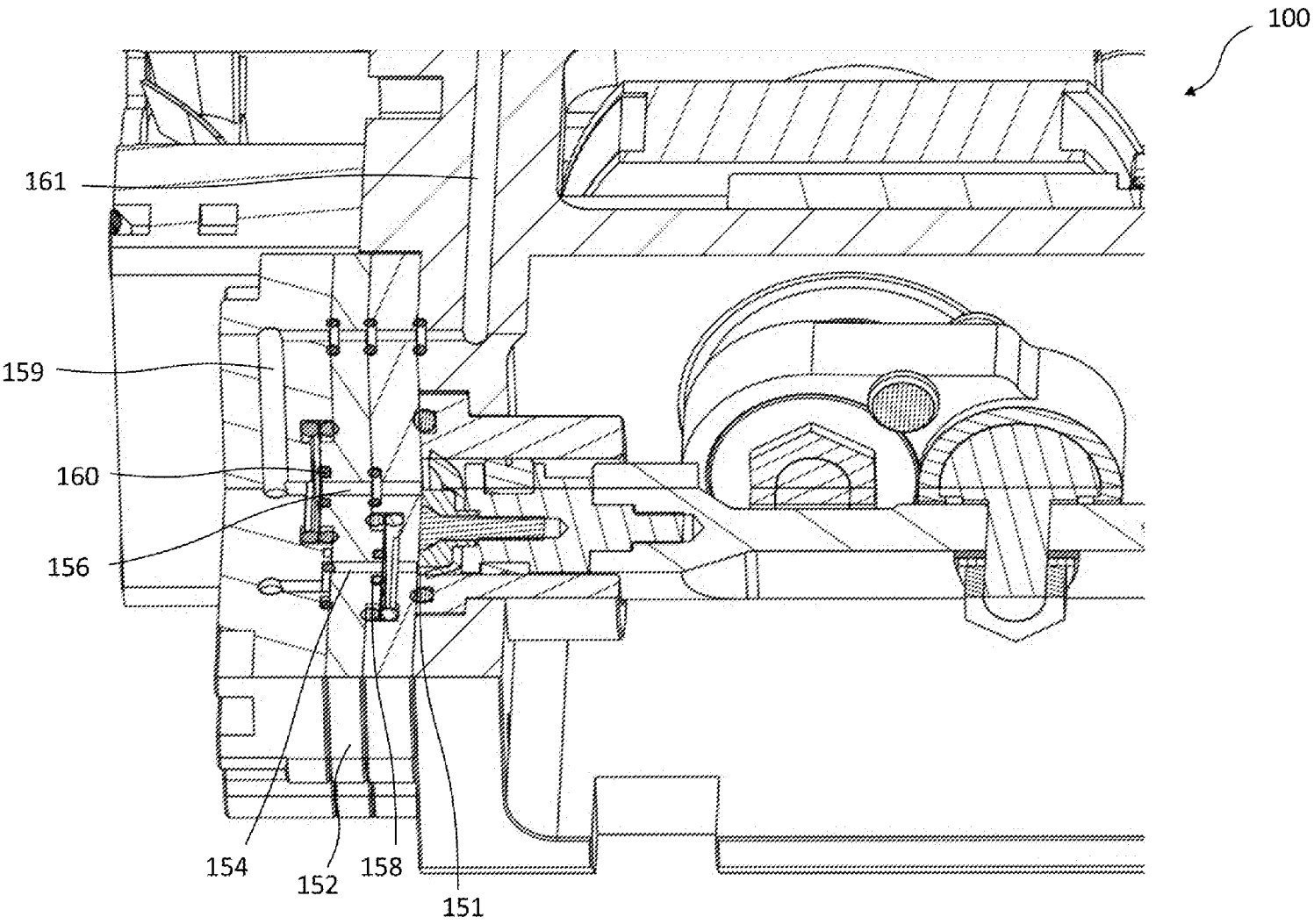
FIG. 4 shows a cut view of a multi-stage electric gas pump at another angle, and shows a fluid passage existing after gas of a second cylinder is discharged from a second outlet.

FIG. 4 shows a cut view of the multi-stage electric gas pump 100 rotated by another angle, and shows the fluid passage after the gas of the second cylinder 118 is discharged from the second outlet 156. As shown in FIG. 4, after being discharged out of the second chamber 151 through the second outlet 156, the pressurized gas enters, through a passage 159 located in the second cylinder cover 152, a passage 161 located in the frame 102.

Figure 5:
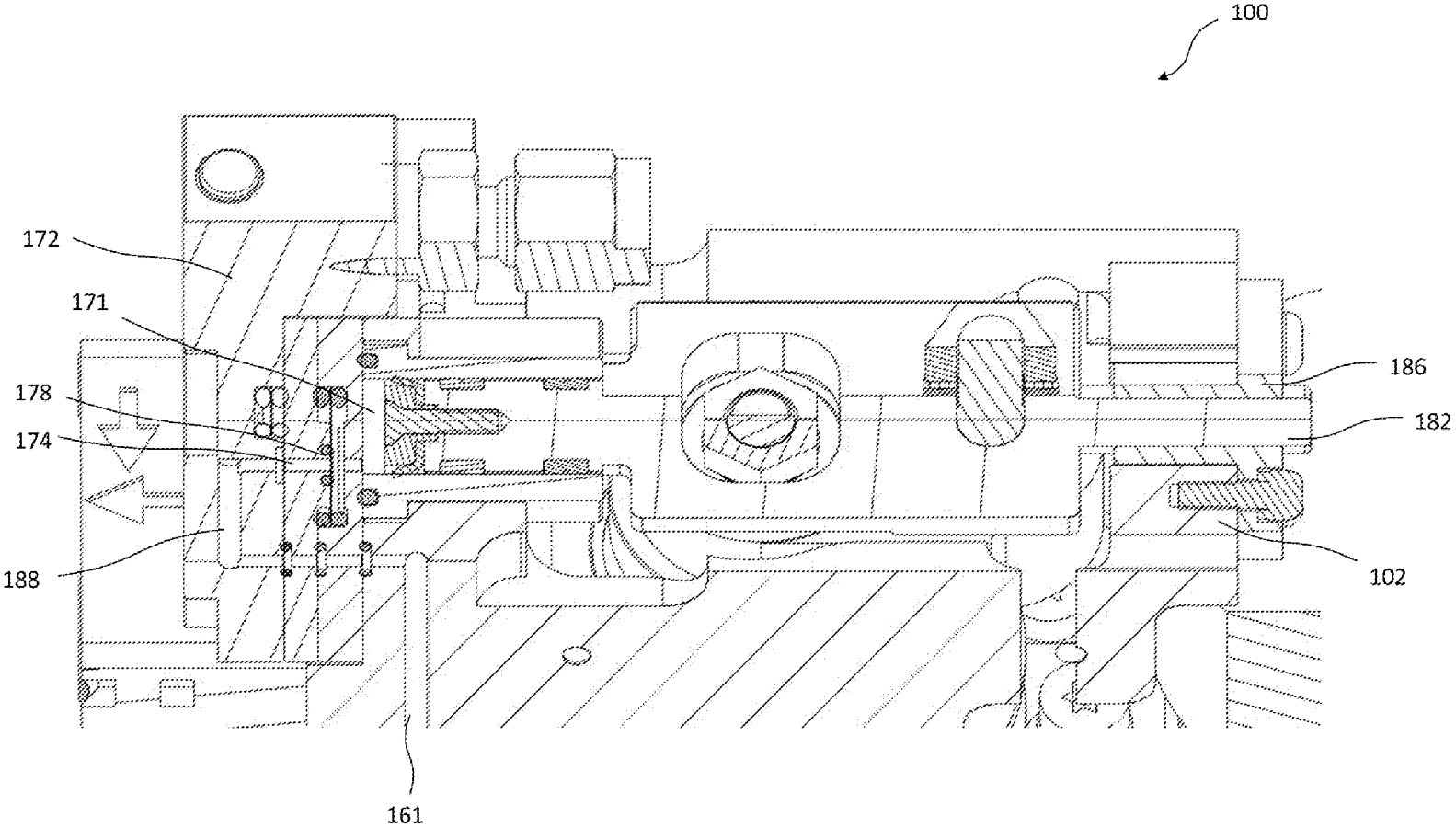
FIG. 5 shows a cut view of a multi-stage electric gas pump at another angle, and shows a fluid passage existing before gas enters a third cylinder.

FIG. 5 shows a cut view of the multi-stage electric gas pump 100 rotated by another angle, and shows the fluid passage before the gas enters the third cylinder 120. As shown in FIG. 5, the pressurized gas enters, through the passage 161 located in the frame 102, a passage 188 located in the third cylinder cover 172, and enters the third chamber 171 through the third inlet 174. In an embodiment, the third inlet 174 is provided with a check valve 178, and the check valve 178 allows the pressurized gas to enter the third chamber 171 only. On the basis of a combination of FIGS. 2-5, it can be learned that the gas entering the gas pump 100 through the gas inlet 112 is sequentially pressurized by the first cylinder 116, the second cylinder 118, and the third cylinder 120 in fluid communication with each other and is then discharged from the gas outlet 114.

Further, referring to FIG. 5 and FIG. 2, the multi-stage electric gas pump further includes a linear bearing 186 fixed on the frame 102. The third piston rod 182 is slidably connected to the linear bearing 186 so as to reciprocate under cooperation of the linear bearing 186. Specifically, one end of the third piston rod 182 is connected to the third piston bush 170, and the other end thereof is connected to the linear bearing 186. These respective ends of the third piston rod 182 may be opposite to each other. Those skilled in the art can understand that this configuration enables the third piston rod 182 to achieve a stable linear reciprocation under driving force of a second eccentric portion 206 of the eccentric shaft 200.

Returning to FIG. 2, the multi-stage electric gas pump 100 further includes the eccentric shaft 200, and the eccentric shaft 200 is fixed to the frame 102 by way of bearings 201*a* and 201*b*. The eccentric shaft 200 includes an elongated main body 202 and a first eccentric portion 204 and a second eccentric portion 206 fixed to two ends of the main body 202. The first and second eccentric portions 204, 206 may be offset from an axis of the main body 202. The main body 202 of the eccentric shaft 200 is fixed to the driven wheel 110 so as to rotate together with the driven wheel 110, and when the main body 202 rotates around a main body axis 203, the first eccentric portion 204 and the second eccentric portion 206 also rotate in synchronization with the main body 202.

Figure 6:
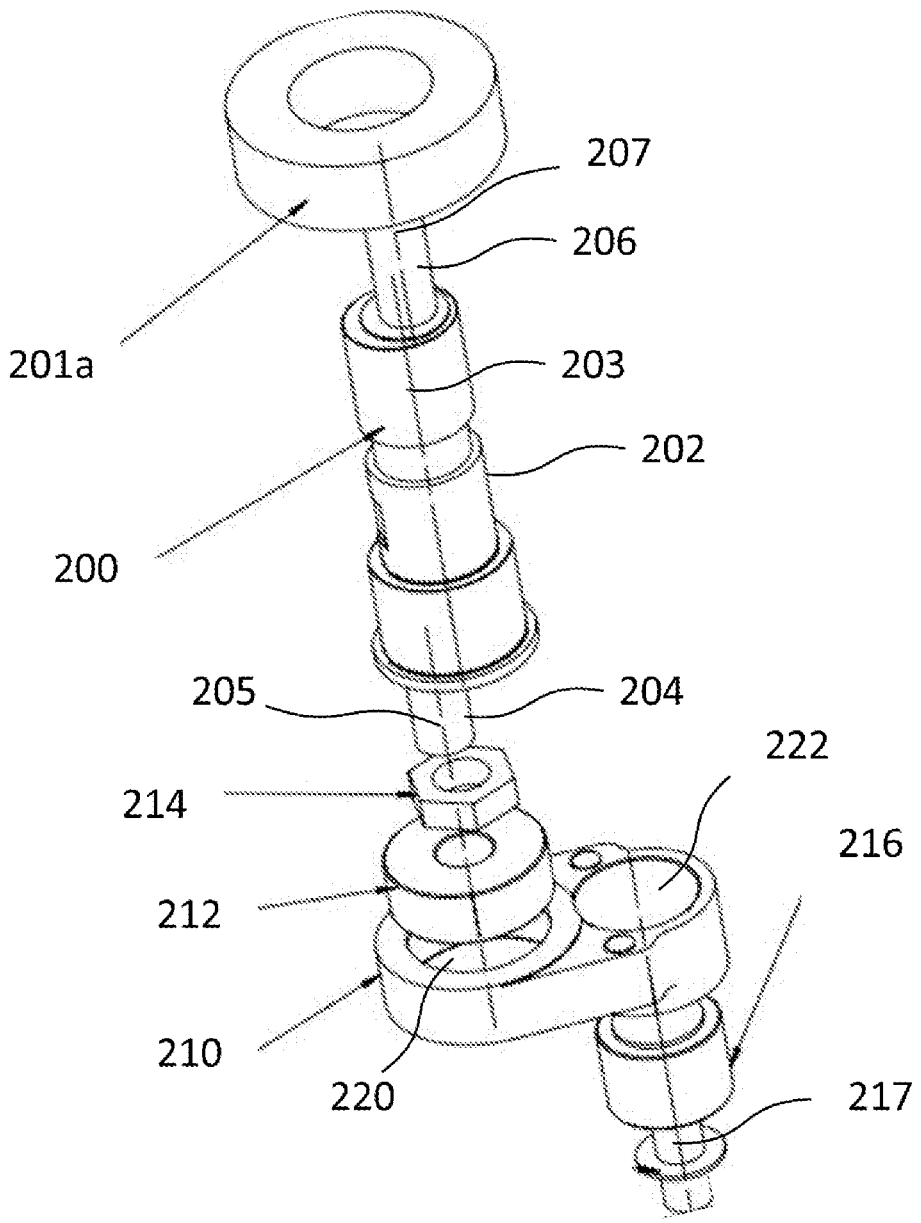
FIG. 6 shows a partially exploded view of a multi-stage electric gas pump, and includes a perspective view of an eccentric shaft as shown in FIG. 2.

FIG. 6 shows a partially exploded view of the multi-stage electric gas pump 100, and includes a perspective view of the eccentric shaft 200 in FIG. 2. As shown in FIG. 6, the main body 202 of the eccentric shaft 200 includes a main body axis 203. Driven by the driven wheel 110, the main body 202 can rotate around the main body axis 203. The first eccentric portion 204 of the eccentric shaft 200 includes a first eccentric axis 205, and the second eccentric portion 206 of the eccentric shaft 200 includes a second eccentric axis 207. In an embodiment, the main body axis 203, the first eccentric axis 205, and the second eccentric axis 207 are parallel to each other, and the first eccentric axis 205 and the second eccentric axis 207 are offset from the main body axis 203. In other words, when the main body 202 rotates around the main body axis 203, both the first eccentric portion 204 and the second eccentric portion 206 perform circular movement around the main body axis 203. In an embodiment, the first eccentric axis 205 and the second eccentric axis 207 are located on two sides of the main body axis 203, and the first eccentric axis 205, the second eccentric axis 207, and the main body axis 203 are on the same plane. In other words, when the main body 202 rotates around the main body axis 203, respective circular movement trajectories of the first eccentric portion 204 and the second eccentric portion 206 differ in phase by 180 degrees.

Continuing to refer to FIG. 2 and FIG. 6, the first eccentric portion 204 is in mechanical cooperation with the first and second piston rods 142, 162, respectively. For example, in an embodiment, the first eccentric portion 204 of the eccentric shaft 200 is directly connected to the first piston rod 142 by way of a first crank 210. Those skilled in the art can understand that although the embodiment in FIG. 2 shows that the first eccentric portion 204 is directly connected to the first piston rod 142, when the first piston rod 142 and the second piston rod 162 have other structures, the first eccentric portion 204 may also be directly connected to the second piston rod 162.

Further, the first crank 210 has a first circular trough 220 located at one end thereof and a second circular trough 222 located at the other end thereof. The first circular trough can accommodate a bearing 212, and the first eccentric portion 204 is fixed to the bearing 212 by way of a nut 214, so that the first crank 210 can rotate around the first eccentric axis 205. The second circular trough 222 can accommodate one end of a first cam bearing 216, so that the first crank 210 can rotate around an axis 217 of the first cam bearing 216. The other end of the first cam bearing 216 is fixed to the first piston rod 162. Those skilled in the art can understand that rotational movement of the first eccentric portion 204 performed around the main body axis 203 can drive the first crank 210 to perform a revolution movement and the revolution movement of the first crank 210 can drive the first piston rod 142 and the second piston rod 162 to reciprocate.

Similarly, referring to FIG. 2, the second eccentric portion 206 is in mechanical cooperation with the third piston rod 182. For example, in an embodiment, the second eccentric portion 206 is connected to the third piston rod 182 by means of a second crank 230. Since the structure of the second crank 230 is similar to the structure of the first crank 210, and since a connection relationship between the second eccentric portion 206 and the third piston rod 182 is similar to a connection relationship between the first eccentric portion 204 and the first piston rod 142, it is not repeatedly described herein. Particularly, those skilled in the art can also understand that rotational movement of the second eccentric portion 206 around the main body axis 203 can drive the second crank 230 to perform a revolution movement and the revolution movement of the second crank 230 can drive the third piston rod 182 to reciprocate. In addition, it can be learned that respective directions of the reciprocations of the first piston rod 142, the second piston rod 162, and the third piston rod 182 are all transverse to the main body axis 203. For example, in an embodiment, the first, second, and third piston rods 142, 162, 182, respectively, are all perpendicular to the main body axis 203.

Those skilled in the art can understand that since the first eccentric portion 204 and the second eccentric portion 206 differ in phase by 180 degrees when rotating around the main body axis 203, and the orientation of the third piston rod 182 is the same as the orientation of the second piston rod 162 and is opposite to the orientation of the first piston rod 142, gas drawing and gas discharging operations of the third piston rod 182 may be contrary to gas drawing and gas discharging operations of the second piston rod 162 and be the same as gas drawing and gas discharging operations of the first piston rod 142. Those skilled in the art can understand that by adjusting a phase difference existing when the first eccentric portion 204 and the second eccentric portion 206 rotate around the main body axis 203 and by accordingly adjusting an orientation of the third piston rod 182 relative to the second piston rod 162, cooperation between the three cylinders can also be achieved so as to achieve three-stage pressurization of gas. For example, it may be configured that the phase difference existing when the first eccentric portion 204 and the second eccentric portion 206 rotate around the main body axis 203 is 0 degrees, and the orientation of the third piston rod 182 is opposite to that of the second piston rod 162 and is the same as the orientation of the first piston rod 142. On the basis of such configurations, only respective positions of the third cylinder 120, the motor 106, the fluid passage in the frame 102, and the like need to be adjusted, and a three-stage pressurization function can be implemented.

Figure 7:
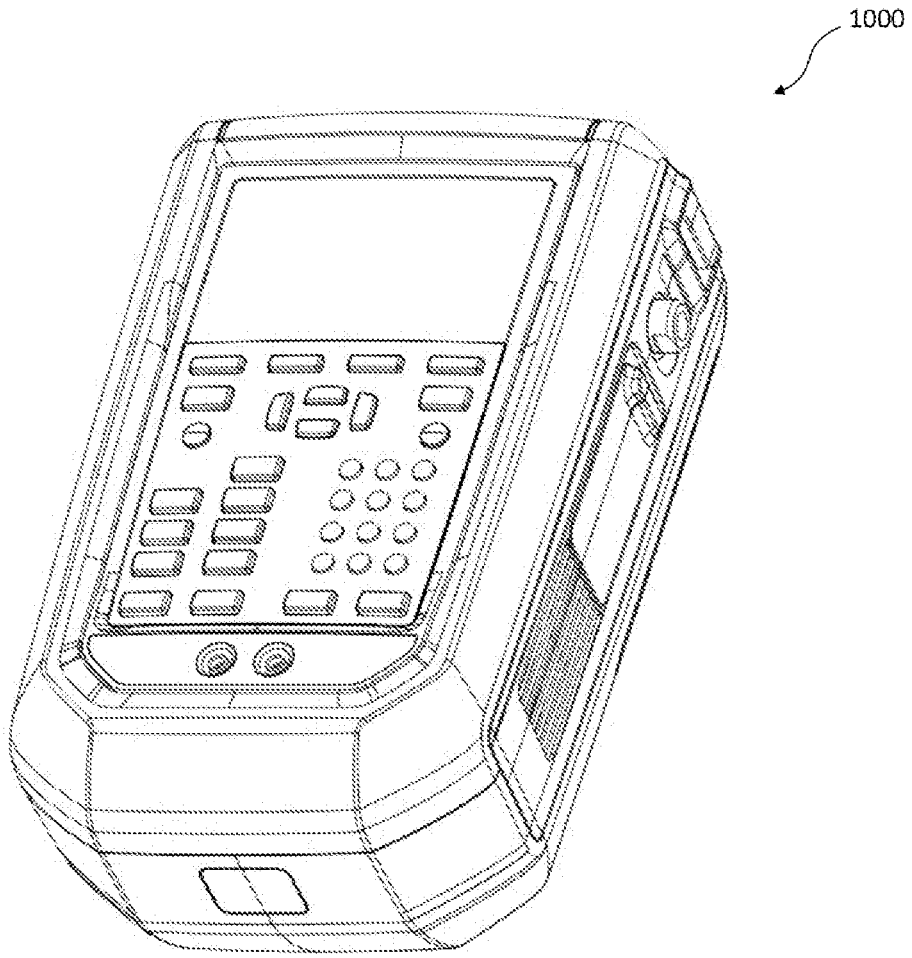
FIG. 7 shows a portable high pressure calibration device according to an embodiment of the present disclosure, the portable high pressure calibration device including a multi-stage electric gas pump according to embodiments of the present disclosure.

FIG. 7 shows a portable high pressure calibration device 1000 according to an embodiment of the present disclosure, the portable high pressure calibration device 1000 including the multi-stage electric gas pump 100 according to an embodiment of the present disclosure. In an operation state, the multi-stage electric gas pump 100 can provide a high-pressure gas source for the high pressure calibration device 1000 so as to implement a calibration function of the calibration device 1000.

Figure 8:
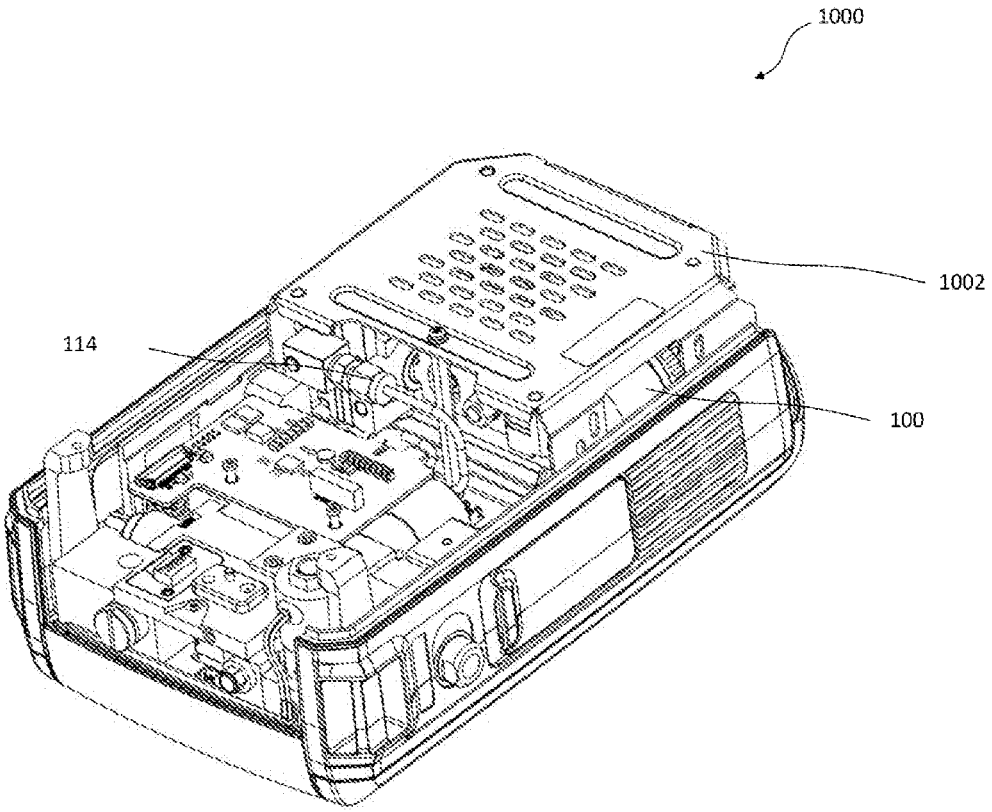
FIG. 8 shows a rear view of the high pressure calibration device as shown in FIG. 7, wherein a rear cover of the high pressure calibration device is removed.

FIG. 8 shows a rear view of the high pressure calibration device 1000 in FIG. 7, wherein a rear cover of the high pressure calibration device is removed. As shown in FIG. 8, the multi-stage electric gas pump 100 is fixed to the high pressure calibration device 1000 by means of a housing 1002, and provides pressurized gas through the gas outlet 114.

The portable high pressure calibration device 1000 may be a handheld device that may be operated by a user with a single hand. For example, the user may be able to actuate buttons on the front of the portable high pressure calibration device 1000 with ease when performing a calibration of a device under test (DUT). The user may be able to lift and move the handheld device between DUTs being calibrated utilizing the portable high pressure calibration device 1000. The handheld nature of the portable high pressure calibration device 1000 provides a user ease of use along with ease of moving the portable high pressure calibration device 1000 relative to other pressure calibration devices that may operate by the user manually actuating a pump. The handheld nature of the portable high pressure calibration device 1000 may allow for a user to easily transport the portable high pressure calibration device 1000 between different sites that may be at different locations to test and calibrate different types of DUTs, for example, pressure measurement devices or instruments.

In various aspects, a multi-stage electric gas pump may thus be summarized as including a driving mechanism; an eccentric shaft including a main body having a longitudinal axis, a first eccentric portion, and a second eccentric portion, wherein the first eccentric portion and the second eccentric portion are fixed on the main body; the eccentric shaft is driven by the driving mechanism to produce a first circular movement of the first eccentric portion performed around the longitudinal axis and a second circular movement of the second eccentric portion performed around the longitudinal axis, wherein the second circular movement is synchronized with the first circular movement; a first cylinder including a first chamber and a first piston rod, and the first piston rod being connected to the first eccentric portion and being configured to reciprocate in response to the first circular movement of the first eccentric portion so as to periodically pressurize gas drawn into the first chamber from an external environment of the multi-stage electric gas pump and then discharge first pressurized gas out of the first chamber; a second cylinder being in fluid communication with the first cylinder, the second cylinder including a second chamber and a second piston rod, and the second piston rod being connected to the first eccentric portion and being configured to reciprocate in response to the first circular movement of the first eccentric portion so as to periodically pressurize the first pressurized gas drawn into the second chamber from the first chamber of the first cylinder and then discharge second pressurized gas out of the second chamber; and a third cylinder being in fluid communication with the second cylinder, the third cylinder including a third chamber and a third piston rod, and the third piston rod being connected to the second eccentric portion and being configured to reciprocate in response to the second circular movement of the second eccentric portion so as to periodically pressurize the second pressurized gas drawn into the third chamber from the second chamber of the second cylinder and then discharge third pressurized gas out of the third chamber.

The second circular movement may be offset by 180 degrees in phase relative to the first circular movement.

The first piston rod and the second piston rod may be connected to each other, and an orientation of the first piston rod may be opposite to an orientation of the second piston rod.

The third piston rod may be parallel to the first piston rod and the second piston rod, and an orientation of the third piston rod may be the same as the orientation of the second piston rod.

The multi-stage electric gas pump may further include a first crank having a first end and a second end, wherein the first end of the first crank may be connected to the first eccentric portion of the eccentric shaft, and the second end of the first crank may be connected to one of the first piston rod and the second piston rod by way of a first cam bearing.

The multi-stage electric gas pump may further include a second crank having a first end and a second end, wherein the first end of the second crank may be connected to the second eccentric portion of the eccentric shaft, and the second end of the second crank may be connected to the third piston rod by way of a second cam bearing.

The first chamber may include a first piston bush and a first cylinder cover; the first cylinder cover may have a first inlet for sucking gas from the external environment and a first outlet for discharging the first pressurized gas; the first piston rod may include a first piston rubber cup; and the first piston rubber cup may be configured to seal the first piston bush together with the first cylinder cover.

The second chamber may include a second piston bush and a second cylinder cover; the second cylinder cover may have a second inlet for sucking the first pressurized gas and a second outlet for discharging the second pressurized gas; the second piston rod may include a second piston rubber cup; and the second piston rubber cup may be configured to seal the second piston bush together with the second cylinder cover.

The third chamber may include a third piston bush and a third cylinder cover; the third cylinder cover may have a third inlet for sucking the second pressurized gas and a third outlet for discharging the third pressurized gas; the third piston rod may include a third piston rubber cup; and the third piston rubber cup may be configured to seal the third piston bush together with the third cylinder cover.

The first inlet, the first outlet, the second inlet, the second outlet, the third inlet, and the third outlet each may include a check valve.

The driving mechanism may be a motor; the multi-stage electric gas pump may further include a driving wheel and a driven wheel; the driving wheel may be connected to the motor, and may be driven by the motor; the driven wheel may be connected to the main body of the eccentric shaft, and may be configured to rotate the main body of the eccentric shaft around the longitudinal axis; connected to the motor, and configured to rotate the main body of the eccentric shaft around the longitudinal axis; the driven wheel may be connected to the driving wheel by means of a belt, and may be driven by the driving wheel.

The motor may be a brushless direct-current motor.

The main body of the eccentric shaft may be elongated, and the first eccentric portion and the second eccentric portion may be respectively located at two ends of the main body of the eccentric shaft.

The longitudinal axis of the main body may be perpendicular to the first piston rod, the second piston rod, and the third piston rod.

A maximum volume of the first chamber may be greater than a maximum volume of the second chamber, and the maximum volume of the second chamber may be greater than a maximum volume of the third chamber.

The third piston connecting rod may be slidably connected to a linear bearing so as to reciprocate under cooperation of the linear bearing.

In various aspects, a multi-stage electric gas pump may be summarized as including a driving mechanism; an eccentric shaft, the eccentric shaft including a main body having a longitudinal axis and at least one eccentric portion connected to the main body, and the eccentric shaft being driven by the driving mechanism so that the eccentric portion performs circular movement around the longitudinal axis; a first cylinder including a first chamber and a first piston rod, and the first piston rod being connected to the eccentric portion and being configured to reciprocate in response to the circular movement of the eccentric portion so as to periodically pressurize gas drawn into the first chamber from an external environment of the multi-stage electric gas pump and then discharge first pressurized gas out of the first chamber; a second cylinder being in fluid communication with the first cylinder, the second cylinder including a second chamber and a second piston rod, and the second piston rod being connected to the eccentric portion and being configured to reciprocate in response to the circular movement of the eccentric portion so as to periodically pressurize the first pressurized gas drawn into the second chamber from the first chamber of the first cylinder and then discharge second pressurized gas out of the second chamber; and a third cylinder being in fluid communication with the second cylinder, the third cylinder including a third chamber and a third piston rod, and the third piston rod being connected to the eccentric portion and being configured to reciprocate in response to the circular movement of the eccentric portion so as to periodically pressurize the second pressurized gas drawn into the third chamber from the second chamber of the second cylinder and then discharge third pressurized gas out of the third chamber, wherein the connections between the first piston rod, the second piston rod, the third piston rod and the eccentric portion are configured so that the second cylinder discharges gas while the first cylinder and the third cylinder draw in gas and that the second cylinder draws in gas while the first cylinder and the third cylinder discharge gas.

Additionally a portable high pressure calibration device may be summarized as including the multi-stage electric gas pump described herein.

Those of ordinary skill in the art can understand and implement other variations of the disclosed embodiments by studying the specification, the disclosure, the accompanying drawings and the claims. In the claims, the word "comprise" does not exclude other elements or steps, and the word "a" or "an" does not exclude a plurality of elements or steps. In practical applications of the present disclosure, one component may perform functions of multiple technical features recited in the description and claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A multi-stage electric gas pump, comprising:

an eccentric shaft including a main body having a longitudinal axis, a first eccentric portion, and a second eccentric portion, wherein the first eccentric portion and the second eccentric portion are fixed on the main body, the eccentric shaft is driven by a driving mechanism to produce a first circular movement of the first eccentric portion around the longitudinal axis and a second circular movement of the second eccentric portion around the longitudinal axis, and the second circular movement is synchronized with the first circular movement;

a first cylinder including a first chamber and a first piston rod, the first piston rod being connected to the first eccentric portion;

a second cylinder in fluid communication with the first cylinder, the second cylinder including a second chamber and a second piston rod, the second piston rod being connected to the first eccentric portion; and a third cylinder in fluid communication with the second cylinder, the third cylinder including a third piston rod and a third chamber, the third piston rod being connected to the second eccentric portion;

wherein the first piston rod and the second piston rod are connected to the first eccentric portion by way of a first crank, the first crank having a first end and a second end, wherein the first end of the first crank is connected to the first eccentric portion, and the second end of the first crank is connected to at least one of the first piston rod or the second piston rod by way of a first cam bearing that is offset from the first eccentric portion, the second piston rod and the first piston rod being connected to each other away from the first eccentric portion.

2. The multi-stage electric gas pump according to claim 1, wherein:

the first cylinder is configured to reciprocate in response to the first circular movement of the first eccentric portion to periodically pressurize gas drawn into the first chamber from an external environment of the multi-stage electric gas pump and discharge first pressurized gas out of the first chamber;

the second cylinder is configured to reciprocate in response to the first circular movement of the first eccentric portion to periodically pressurize the first pressurized gas drawn into the second chamber from the first chamber of the first cylinder and discharge second pressurized gas out of the second chamber; and the third cylinder is configured to reciprocate in response to the second circular movement of the second eccentric portion to periodically pressurize the second pressurized gas drawn into the third chamber from the second chamber of the second cylinder and discharge third pressurized gas out of the third chamber.

3. The multi-stage electric gas pump according to claim 2, wherein the second circular movement is offset by 180 degrees in phase relative to the first circular movement.

4. The multi-stage electric gas pump according to claim 3, wherein:

an orientation of the first piston rod is opposite to an orientation of the second piston rod; and the third piston rod is parallel to the first piston rod and the second piston rod, and an orientation of the third piston rod and the orientation of the second piston rod are the same.

5. The multi-stage electric gas pump according to claim 1, further comprising a second crank having a first end and a second end, wherein the first end of the second crank is connected to the second eccentric portion of the eccentric shaft, and the second end of the second crank is connected to the third piston rod by way of a second cam bearing.

6. The multi-stage electric gas pump according to claim 1, wherein:

the first chamber is at least partially delimited by a first piston bush and a first cylinder cover;

the first cylinder cover has a first inlet for drawing gas from an external environment and a first outlet for discharging first pressurized gas;

the first piston rod includes a first piston cup; and the first piston cup is configured to seal the first piston bush together with the first cylinder cover.

7. The multi-stage electric gas pump according to claim 6, wherein:

the second chamber is at least partially delimited by a second piston bush and a second cylinder cover;

the second cylinder cover has a second inlet for drawing the first pressurized gas and a second outlet for discharging second pressurized gas;

the second piston rod includes a second piston cup; and the second piston cup is configured to seal the second piston bush together with the second cylinder cover.

8. The multi-stage electric gas pump according to claim 7, wherein:

the third chamber is at least partially delimited by a third piston bush and a third cylinder cover;

the third cylinder cover has a third inlet for drawing the second pressurized gas and a third outlet for discharging third pressurized gas;

the third piston rod includes a third piston cup; and the third piston cup is configured to seal the third piston bush together with the third cylinder cover.

9. The multi-stage electric gas pump according to claim 8, wherein the first inlet, the first outlet, the second inlet, the second outlet, the third inlet, and the third outlet each include a check valve.

10. The multi-stage electric gas pump according to claim 1, further comprising a driving wheel, a driven wheel, and a belt, wherein:

the driving mechanism is a motor;

the driving wheel is connected to the motor and is driven by the motor;

the driven wheel is connected to the main body of the eccentric shaft and is configured to rotate the main body of the eccentric shaft around the longitudinal axis; and the belt is connected to the driven wheel and to the driving wheel, and is driven by the driving wheel.

11. The multi-stage electric gas pump according to claim 1, wherein the main body of the eccentric shaft is elongated, and the first eccentric portion and the second eccentric portion are respectively located at two ends of the main body of the eccentric shaft.

12. The multi-stage electric gas pump according to claim 1, wherein the longitudinal axis of the main body is transverse to the first piston rod, the second piston rod, and the third piston rod.

13. The multi-stage electric gas pump according to claim 1, wherein a maximum volume of the first chamber is greater than a maximum volume of the second chamber, and the maximum volume of the second chamber is greater than a maximum volume of the third chamber.

14. The multi-stage electric gas pump according to claim 1, wherein the third piston rod is slidably connected to a linear bearing to reciprocate in cooperation with the linear bearing.

15. A multi-stage electric gas pump, comprising:

a driving mechanism;

an eccentric shaft including a main body having a longitudinal axis and one or more eccentric portions connected to the main body, and the eccentric shaft being driven by the driving mechanism so that the one or more eccentric portions perform circular movement around the longitudinal axis;

a first cylinder, a second cylinder, and a third cylinder in mechanical cooperation with the eccentric shaft, wherein the one or more eccentric portions include a first eccentric portion and a second eccentric portion configured so that, in operation, the circular movement of the first and second eccentric portions cause the second cylinder to discharge gas while the first cylinder and the third cylinder draw in gas, and the second cylinder to draw in gas while the first cylinder and the third cylinder discharge gas; and wherein the first cylinder, the second cylinder, and the third cylinder are in mechanical cooperation with the eccentric shaft by way of a plurality of cranks, wherein a first crank of the plurality of cranks connects a first piston in the first cylinder and a second piston in the second cylinder to the first eccentric portion of the eccentric shaft, the first crank having a first end and a second end, the first end being connected to the first eccentric portion, and the second end being connected by way of a first cam bearing to at least one of a first piston rod of the first piston, or a second piston rod of the second piston, the first cam bearing being offset from the first eccentric portion, wherein the second piston rod and the first piston rod are connected to each other away from the first eccentric portion; and wherein a second crank of the plurality of cranks connects a third piston in the third cylinder to the second eccentric portion of the eccentric shaft, the second crank having a first end and a second end, wherein the first end of the second crank is connected to the second eccentric portion, and the second end of the second crank is connected by way of a second cam bearing to a third piston rod of the third piston.

16. A portable high pressure calibration device, comprising:

a multi-stage electric gas pump including:

an eccentric shaft including a main body having a longitudinal axis, a first eccentric portion, and a second eccentric portion, wherein the first eccentric portion and the second eccentric portion are fixed on the main body, the eccentric shaft is driven by a driving mechanism to produce a first circular movement of the first eccentric portion around the longitudinal axis and a second circular movement of the second eccentric portion around the longitudinal axis, and the second circular movement is synchronized with the first circular movement; and a plurality of cylinders each including a piston rod and a chamber, wherein a first piston rod of a first cylinder and a second piston rod of a second cylinder are in mechanical cooperation with the first eccentric portion by way of a first crank, the second piston rod and the first piston rod being connected to each other away from the first eccentric portion;

wherein the first crank has a first end and a second end, the first end of the first crank being connected to the first eccentric portion, and the second end of the first crank being connected by way of a first cam bearing to at least one of the first piston rod or the second piston rod, the first cam bearing being offset from the first eccentric portion.

17. The portable high pressure calibration device according to claim 16, wherein the first and second piston rods are in mechanical cooperation with the first eccentric portion and a third piston rod of a third cylinder is in mechanical cooperation with the second eccentric portion so that, in operation, the second cylinder of the plurality of cylinders discharges gas while the first cylinder and the third cylinder of the plurality of cylinders draw in gas, and the second cylinder draws in gas while the first cylinder and the third cylinder discharge gas.

18. The portable high pressure calibration device according to claim 16, further comprising:

a second crank in mechanical cooperation with the second eccentric portion of the eccentric shaft and a third piston rod of a third cylinder, wherein the second crank has a first end and a second end, the first end of the second crank being connected to the second eccentric portion, and the second end of the second crank being connected by way of a second cam bearing to the third piston rod.

* * * * *